United States Patent [19]

Petrantoni

[11] Patent Number: 4,551,988

[45] Date of Patent: Nov. 12, 1985

[54] CHAMBERED COOLER

[76] Inventor: Joseph Petrantoni, 2549 Keystone Rd., Tarpon Springs, Fla. 33589

[21] Appl. No.: 622,209

[22] Filed: Jun. 19, 1984

[51] Int. Cl.[4] ..... F25D 3/08

[52] U.S. Cl. ..... 62/457; 62/530

[58] Field of Search ..... 62/457, 529, 530, 371, 62/372

[56] References Cited

U.S. PATENT DOCUMENTS

| | | | |
|---|---|---|---|
| 2,187,387 | 1/1940 | Trigg et al. | 62/457 X |
| 2,496,296 | 2/1950 | Lobl | 62/457 X |
| 2,504,911 | 4/1950 | Whitecar | 62/530 X |
| 2,559,121 | 7/1951 | Hertzberg | 62/457 |
| 3,255,607 | 6/1966 | Bair et al. | 62/457 X |
| 4,441,336 | 4/1984 | Cannon | 62/457 |
| 4,446,705 | 5/1984 | Loucks | 62/457 X |

*Primary Examiner*—Lloyd L. King

*Attorney, Agent, or Firm*—Stein & Reese

[57] ABSTRACT

A chambered cooler for insertion within a chest including a chest base having upstanding side walls and a bottom wall forming an open ended chest enclosure, including a chest lid for positioning about the opened end of the chest enclosure, and being dimensioned to receive articles to be cooled or heated when placed therein.

9 Claims, 7 Drawing Figures

CHAMBERED COOLER

BACKGROUND OF THE INVENTION

1. Field of the Invention

This invention relates to chests in which articles are to be placed to be cooled or heated, or kept at a constant temperature. More particularly, this invention relates to ice chests designed to hold blocks or cubes of ice together with the articles to be cooled.

2. Description of the Prior Art

Presently there exist numerous types of insulative chests designed to store articles therein and to either heat or cool the article from its initial temperature. The most basic type of such insulative chests is what is commonly referred to as "ice chests". These ice chests typically include a generally rectangular, open-ended configuration. A lid, either removable or hinged to the chest, is provided to cover the opened end of the chest. During use, articles to be cooled, such as picnic foods, are placed within the chest along with a block of ice and/or a supply of ice cubes. The ice contained within the ice chest functions to cool the articles placed therein.

One major disadvantage to any type of insulative chest utilizing ice as the cooling medium is the fact that the ice will, over time, melt and wet the articles placed within the ice chest. The wetting of the articles to be cooled with water often ruins the article completely such as, for example, a soaked sandwich. The wetting of the articles is also highly undesirable because of the mere fact that the articles usually must be wiped dry prior to use. Accordingly, there exists a great need in the industry for a means for preventing the articles to be cooled from being contaminated by melted ice.

Another major disadvantage to conventional ice chests is the fact that the articles to be cooled cannot be cooled to 32 degrees Fahrenheit or cooler. Some articles, such as containers of ice cream, will not be maintained in their frozen condition when stored in conventional ice chests. Accordingly, such frozen articles will typically thaw over a relatively short period of time.

Therefore, it is an object of this invention to provide an apparatus which overcomes the aforementioned inadequacies of the prior art devices and provides an improvement which is a significant contribution to the advancement of the insulative chest art.

Another object of this invention is to provide a chambered cooler for insertion into conventional insulative chests such as ice chests.

Another object of this invention is to provide a chambered cooler which is formed integrally with an ice chest.

Another object of this invention is to provide a chambered cooler designed to receive the cooling medium such as ice cubes therein in such a manner that, upon melting of the ice, the resulting water does not contaminate the articles stored within the ice chest.

Another object of this invention is to provide a chambered cooler having an opened end covered with a lid for permitting sodium chloride to be poured into the chambered cooler with the ice cubes to increase the melting of the ice while bringing the temperature within the ice chest at or below 32 degrees Fahrenheit.

Another object of this invention is to provide a chambered cooler having a drain for draining the melted ice from within the chamber.

Another object of this invention is to provide a chambered cooler having a bottom, primary chamber approximating the bottom configuration of the ice chest so that the articles to be cooled are placed on top of the bottom chamber during storage within the ice chest.

Another object of this invention is to provide a chambered cooler including a bottom, primary chamber and an upstanding, secondary chamber, each designed to receive ice and, if desired, sodium chloride, therein to enhance the cooling of the articles placed within the ice chest.

Another object of this invention is to provide a chambered cooler having a bottom, primary chamber and an upstanding, open-ended, secondary chamber, with the open end of the secondary chamber being closed by means of a lid.

Another object of this invention is to provide a chambered cooler having a primary, bottom chamber and an upstanding, secondary chamber with a lid, and further having a removable basket dimensioned to fit into an ice chest and operatively connected to the lid of the secondary cooler so as to retain the lid in a closed position.

Another object of this invention is to provide a chambered cooler having a bottom, primary chamber and an upstanding, secondary chamber positioned at the middle portion thereof with a pair of baskets operatively connected to opposing sides of the lid fitted about the opened end of the upstanding, secondary chamber.

Another object of this invention is to provide a chambered cooler having a bottom, primary chamber and two upstanding, opened-ended, secondary chambers, each covered with a lid and a basket configured to fit between the upstanding, secondary walls and be operatively connected to the respective lids to retain the lids in their closed positions about the opened end of the secondary chambers.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a chambered cooler fitted within an insulative chest such as an ice chest. The chambered cooler includes an open-ended configuration having a lid fitted about the opening thereof. The chambered cooler is designed to receive cubed or crushed ice and, if desired, a supply of sodium chloride (salt). A removable basket may be provided for operative connection to the lid of the open-ended, chambered cooler to retain the lid in a closed position when the basket is insert into the insulative chest.

In its preferred embodiment, the chambered cooler of the invention includes a bottom, primary chamber and an upstanding, open-ended secondary chamber positioned along the longitudinal midportion of the primary chamber, with the lid being fitted about the opened end of the secondary chamber. A plurality of article containers such as baskets are designed to be fitted on opposing sides of the upstanding, secondary chamber above the primary chamber. Preferably, the article containers are operatively connected to the lid to retain the lid in its closed position about the opened end of the secondary chamber when the article containers are inserted within the insulative chest.

During use, a properly sized chambered cooler is inserted within a conventional insulative chest such as an ice chest. The primary and secondary chambers of the chambered cooler are then filled with cubed or crushed ice via the opened end of the secondary chamber. Rock salt (sodium chloride) may then be sprinkled within the secondary chamber to enhance the cooling effect of the ice contained therein. The lid is then fitted about the opened end of the secondary chamber so as to completely incapsulate the ice and the rock salt therein and prevent any melted ice from flowing into the interior of the ice chest. The article containers, such as baskets, are then filled with the articles to be cooled, such as sandwiches, cold drinks, and containers of macaroni salad. The filled article containers are then fitted into the zones on opposing sides of the upstanding, secondary chamber. If it is not desirable to utilize the article containers, the articles to be cooled may be stacked on top of the bottom, primary chamber within the chest.

It should be quickly realized that the aforementioned brief summary of the invention over comes many of the disadvantages associated with the prior art devices as briefly outlined above. Specifically, the chambered cooler of the invention in which is contained the ice and the rock salt, retains all melted ice and salt within the chamber itself. In this manner, contamination of the articles to be cooled with melted ice and salt is precluded. The consumer is, therefore, able to fill the ice chest with all types of articles such as sandwiches, canned drinks, condiments and containers of food without fear that the food will be contaminated with melted ice and salt.

Additionally, through the use of the article containers, it is equally apparent that the consumer could fill the containers with articles of the same character; such as, filling one basket will cold drinks, another basket with condiments and still another basket with sandwiches. With the articles so segregated, the articles are conveniently stored in a highly organized manner within the ice chest. The possibility that heavier articles will damage more fragile ones, such as canned drinks breaking glass containers of condiments and crushing bread, is eliminated. Further, it is readily apparent that each basket may be individually removed from the ice chest to facilitate further removal of the articles therefrom. For example, the container containing all of the canned drinks could be removed from the ice chest and passed around to a group of consumers, thereby allowing each consumer to select his or her particular beverage from the container.

Another major advantage to the chambered cooler invention is the fact that sodium chloride, such as that in the form of rock salt, may be sprinkled within the chamber on top of the ice contained therein. The addition of the rock salt to the ice causes the ice to melt more rapidly, thereby absorbing more heat from the surrounding areas such as from the articles to be cooled. Overall, this has the thermodynamic effect of decreasing the temperature within the cooler below that which is normally obtained through the use of only ice; namely, thirty-two degrees Fahrenheit. Accordingly, it is readily apparent that the additional use of rock salt within the chambered cooler may be used in such instances in which it is desirable to decrease the temperature within the ice chest below thirty-two degrees Fahrenheit. This permits frozen articles such as ice cream and frozen meats, to be stored with in the ice chest and maintained in their frozen condition for a substantial period of time.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several view of the drawings.

DETAILED DESCRIPTION OF THE PREFERRED EMBODIMENT

Figure 1:
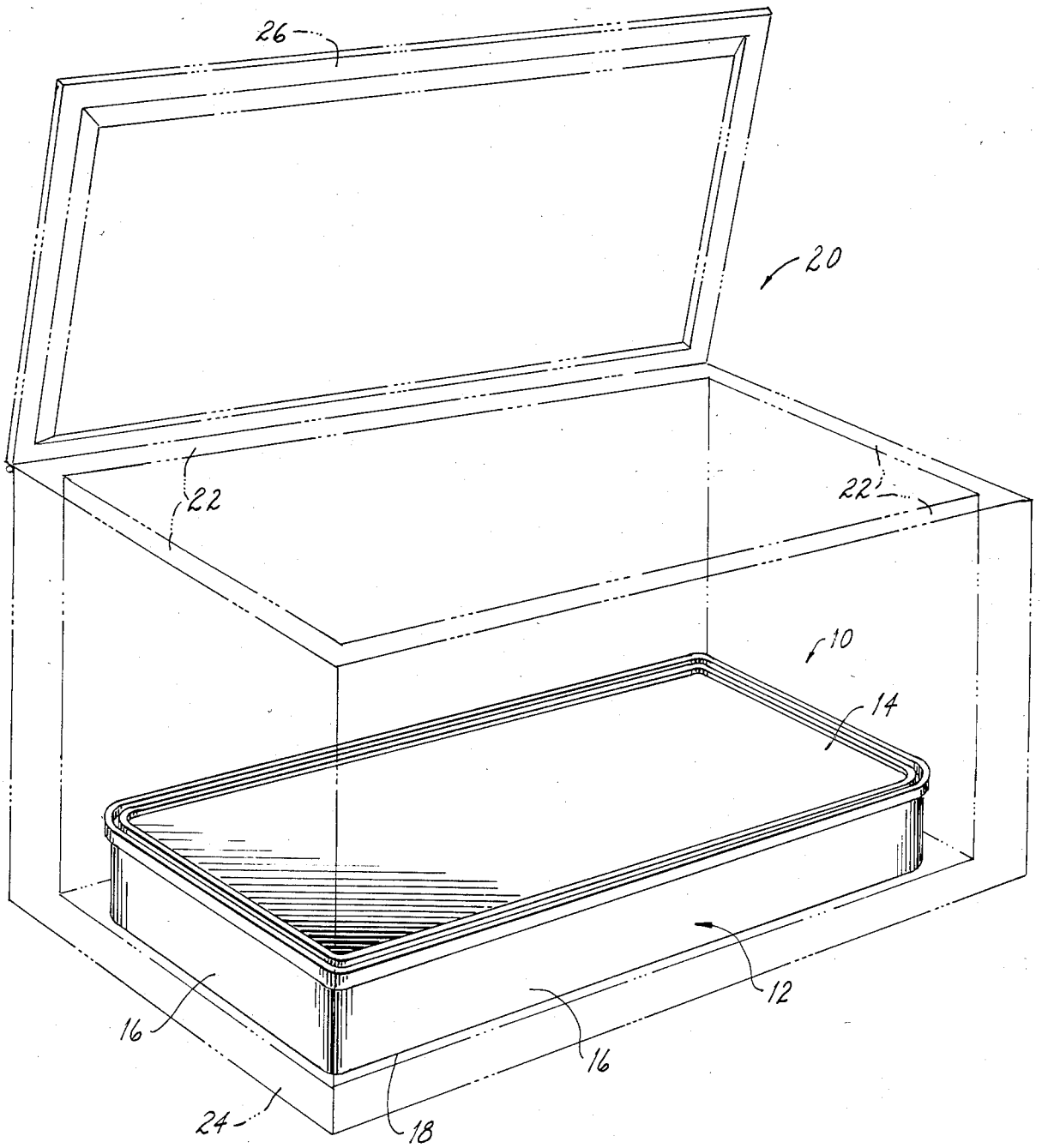
FIG. 1 is a perspective view of the chambered cooler of the invention positioned within an ice chest illustrated in phantom.

FIG. 1 is a perspective view of the chambered cooler 10 of the invention in its simplest form including a bottom, primary chamber 12 and a lid 14. The primary chamber 12 comprises upstanding side walls 16 and bottom wall 18 which, together, form an open-ended enclosure. The lid 14 is dimensioned and configured to be fitted about the open end of the primary chamber 12. The chambered cooler 10 is designed to be fitted within an insulative chest such as an ice chest 20, as shown in phantom in FIG. 1. Conventional ice chests 20 include upstanding side walls 22 and a bottom wall 24 which together form an open ended enclosure. A lid 26 is removably or hingedly connected to the open end of the ice chest 20 to permit closing thereof. Typically, walls 22 and 24 and lid 26 comprise laminated, insulative materials designed to insulate the interior of the ice chest 20 from the outside environment.

As shown in FIG. 1, the basic structure of the chambered cooler 10 preferably comprises a bottom, primary chamber 12 having a width and length which approximate the interior width and length of the ice chest 20 such that the primary chamber 12 may be fitted in the bottom of the ice chest 20 and prevented from excessive shifting therein during transport of the ice chest 20. During use, the lid 14 is removed from the chambered cooler 10 and the cooler 10 is filled with cubed or crushed ice. A supply of rock salt or the like is then sprinkled on top of the ice within the cooler 10. The lid 14 is then replaced in its closed position about the opened end of the cooler 10. The articles to be cooled are placed within the ice chest 20 on top of the primary chamber 12, and the lid 26 of the ice chest 20 is closed. The ice contained within the cooler 10 absorbs the heat contained within the ice chest 20 together with the latent heat of the articles. As the heat is absorbed by the ice, the ice melts within the cooler 10. Obviously, the cooler 10 retains all of the liquid resulting from the melted ice thereby preventing the melted ice from contaminating the articles within the ice chest 20. Depending on the amount of rock salt sprinkled on the ice in the cooler 10, the temperature within the ice chest 20 decreases the desired amount.

Figure 2:
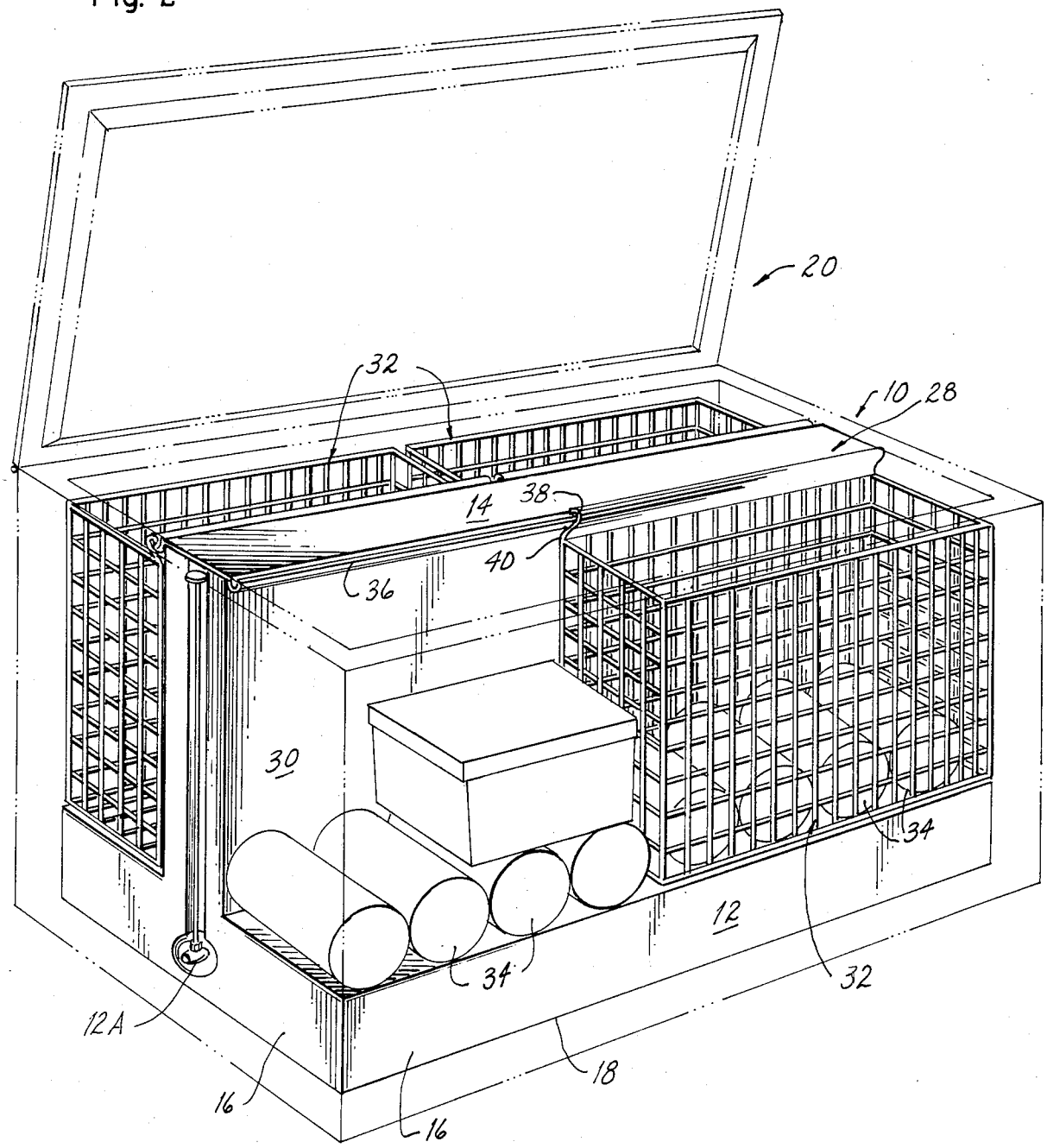
FIG. 2 is a perspective view of the first embodiment of the chambered cooler of the invention positioned with an ice chest, shown in phantom.
Figure 3:
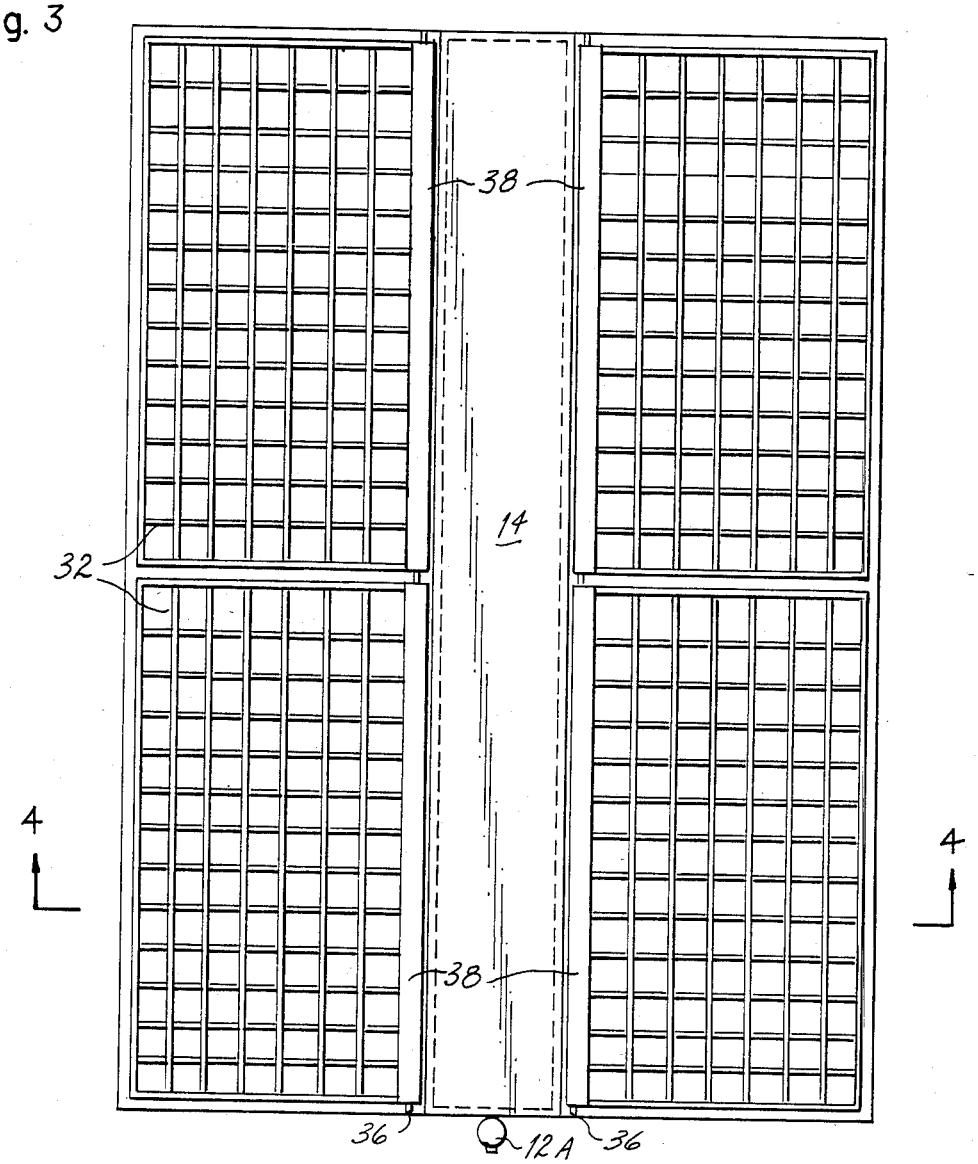
FIG. 3 is a top plan view of the first embodiment of the chambered cooler of the invention illustrating the placement of the plurality of article containers on opposing sides of the upstanding, secondary chamber.
Figure 4:
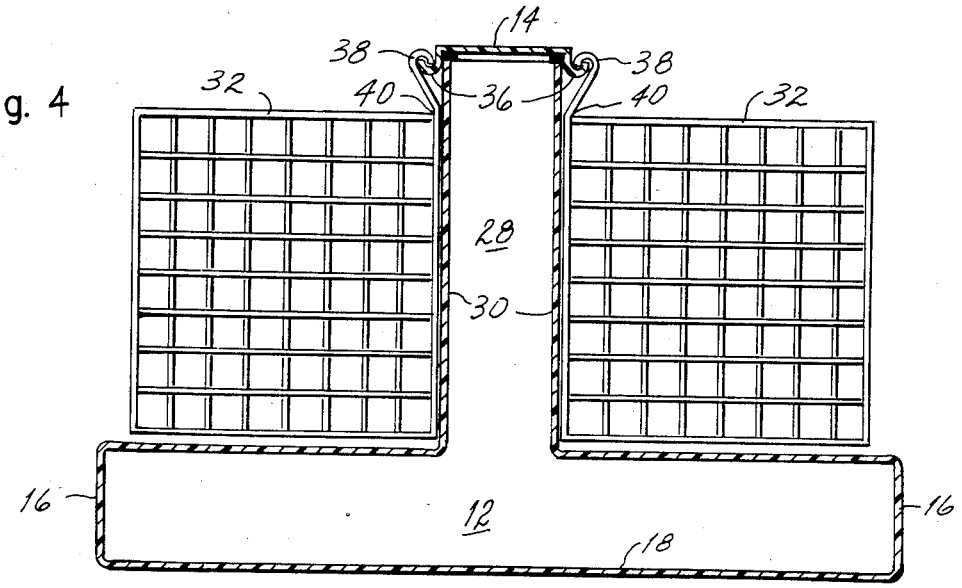
FIG. 4 is a cross-sectional view of FIG. 3 along lines 4—4.

FIG. 2 is a perspective view of the preferred embodiment of the chambered cooler 10 of the invention inserted within a conventional ice chest 20. Specifically, the preferred embodiment of the chambered cooler 10 comprises a bottom, primary chamber 12 having side walls 16 and bottom wall 18. The width and length of the primary chamber 12 is dimensioned to approximate the interior width and length of the ice chest 20 to preclude shifting therein during transport of the ice chest 20. The chambered cooler 10 further comprises an upstanding, secondary cooler 28 having upstanding side walls 30 defining an open ended chamber which is connected in fluid communication with the primary chamber 12. Lid 14 is then dimensioned and configured to fit about the open end of the secondary chamber 28 to form a completely closed chambered cooler 10. A drain valve 12A is connected in fluid communication with the primary chamber 12.

In the first embodiment of the chambered cooler 10, the secondary chamber 28 includes an elongated, rectangular configuration which is connected in fluid communication with the primary chamber 12 along the longitudinal length thereof at its midportion, thereby defining storage zones on opposing sides of the secondary chamber 28.

The chambered cooled 10 of the invention further comprises a plurality of article containers 32 dimensioned and configured to fit within the storage zones on opposing sides of the upstanding, secondary chamber 28. Preferably, article containers 32 comprise baskets which are dimensioned to conveniently store standard sized articles such as canned drinks 34. The article containers 32 are operatively connected to the lid 14 of the chambered cooler 12 in such a manner that the article containers 32 retain the lid 14 in its closed position about the open end of the secondary chamber 28, and yet are removable from within the ice chest 20. For example, the means for operatively connecting the article containers 32 to the lid 14 may include forming an upturned flange 36 along the opposing edges of the lid 14 which correspondingly mates with a hooked flanged 38 formed along the inner edge 40 of the article containers 32. In this embodiment, it is readily apparent that the article containers 32 are suspended from the lid 14 within the ice chest 20 thereby securing lid 14 in its closed position about the opened end of the secondary chamber 28. It is additionally apparent that the article containers 32 may be conveniently removed from within the ice chest 20 simply by lifting upwardly on the article containers 32 with a slight pivoting action to disengage the hooked flange 38 from the upturned flange 36. Conversely, the article containers 32 can be quickly and easily reinstalled within the ice chest 20.

Figure 5:
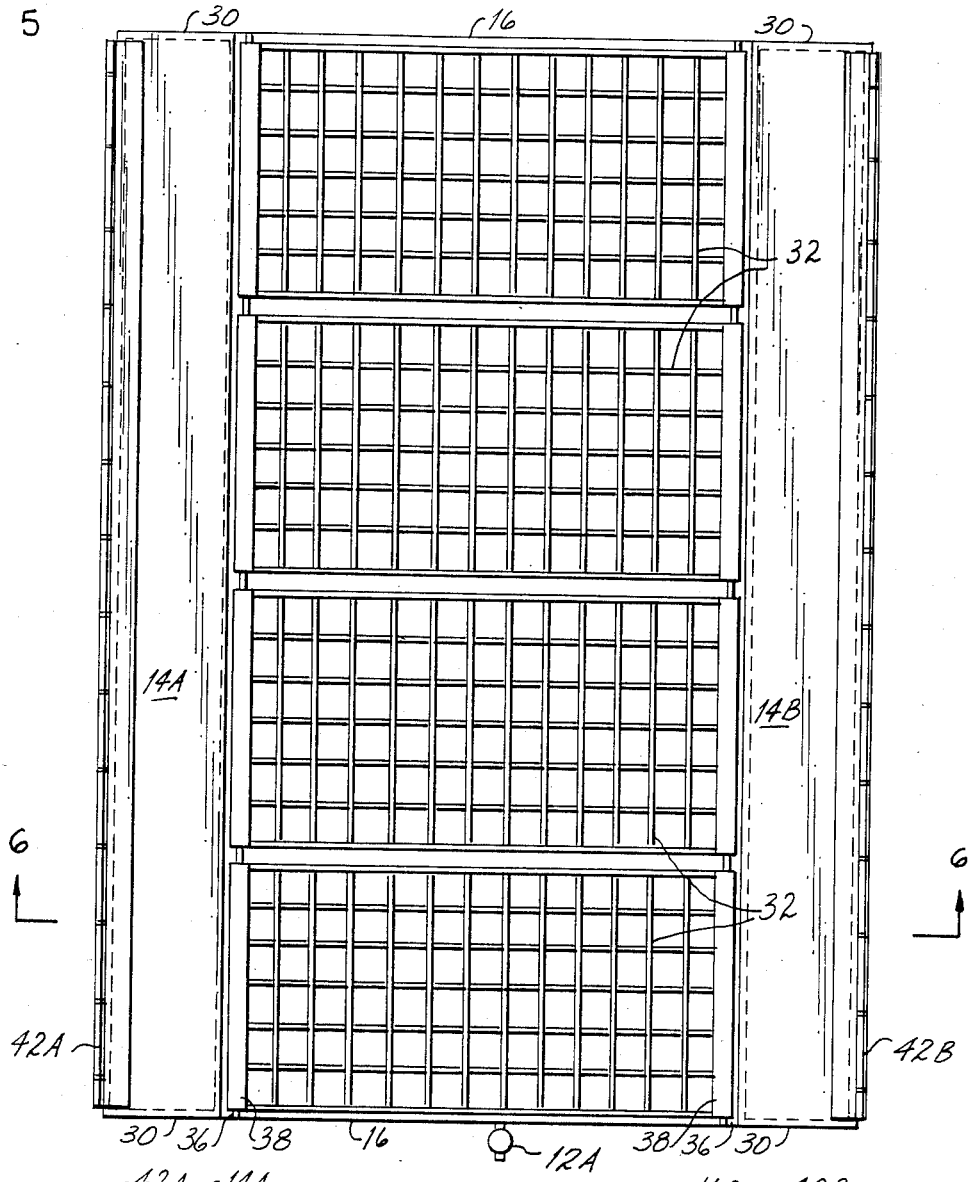
FIG. 5 is a top plan of the second embodiment of the chambered cooler of the invention illustrating the plurality of article containers positioned within the storage zone between the pair of upstanding, secondary chambers.
Figure 6:
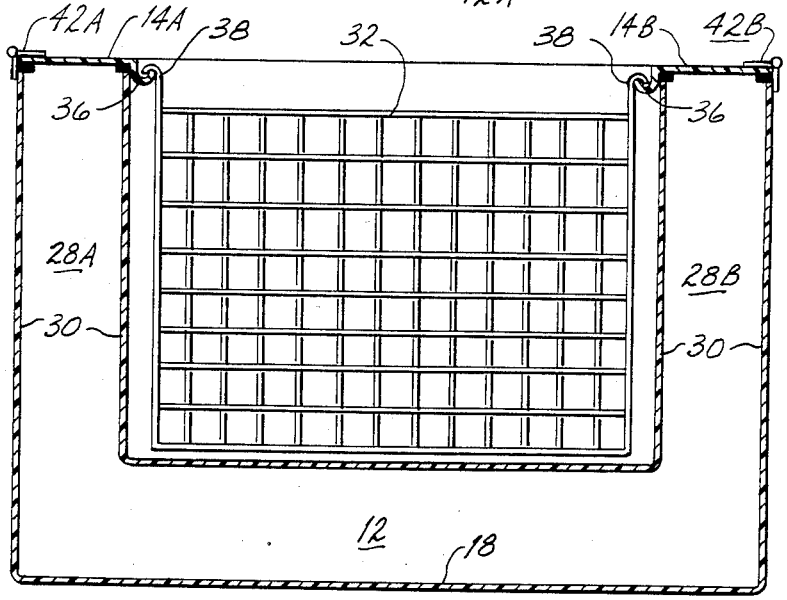
FIG. 6 is a cross-sectional view of FIG. 5 along lines 6—6.

As shown in FIGS. 5 and 6, the second embodiment of the chambered cooler 10 is similar in operation to the first embodiment, but includes a pair of upstanding, secondary chambers 28A and 28B which are connected in fluid communication with the primary chamber 12 at the longitudinal side edges thereof. Each secondary chamber 28A and 28B includes upstanding side walls 30 which, together with side walls 16 of the primary chamber 12, define the secondary chambers 28A and 28B and the primary chamber 12.

Each of the secondary chambers 28A and 28B are open ended and include a lid 14A and 14B positioned about the open end to completely enclose the primary chamber 12 and the secondary chambers 28A and 28B thereby preventing leakage of any fluid contained within the chambers 12 and 28A and 28B. Preferably, lids 14A and 14B are hingedly connected along one of their sides to the outermost side walls 30 by means of a piano hinge 42A and 42B, respectively. However, it should be understood that the hinges 42A and 42B may alternatively comprise a tab and groove arrangement which allows the pivoting and/or removal of the lids 14A and 14B.

Similar to the first embodiment, the second embodiment of the chambered cooler 10 includes a plurality of article containers 32 dimensioned and configured to be inserted within the storage zone between the upstanding, secondary chambers 28A and 28B. Specifically, the article containers 32 such as baskets, may preferably comprise a generally rectangular configuration for transverse placement within the storage zones between the secondary chambers 28A and 28B. Also preferably, the article containers 32 are operatively connected to the other longitudinal edge of each of the lids 14A and 14B such that the article containers 32 retain the lids 14A and 14B in their closed positions when the article containers 32 are installed into position between the upstanding, secondary chambers 28.

While other means are available, the preferred means for operatively connecting the article containers 32 to the lids 14A and 14B comprise forming an upturned flange 36 along the length of each of the lids 14A and 14B which mate with a corresponding hooked flanged 38 formed along the opposing edges of each of the article containers 32. In this manner, one or all of the article containers 32 may be quickly and easily removed from within the storage zones between the upstanding secondary chambers 28A and 28B. Furthermore, after all of the article containers 32 have been removed from the storage zone, one or both of the lids 14A and 14B may be pivoted open thereby permitting the chambers 12 and 28A and 28B to be filled with ice and, if desired, rock salt. After filling of the chambers 12 and 28A and 28B, the lids 14A and 18B may be closed and, upon insertion of the article containers 32 within the storage zone, securely retained in their closed position.

Figure 7:
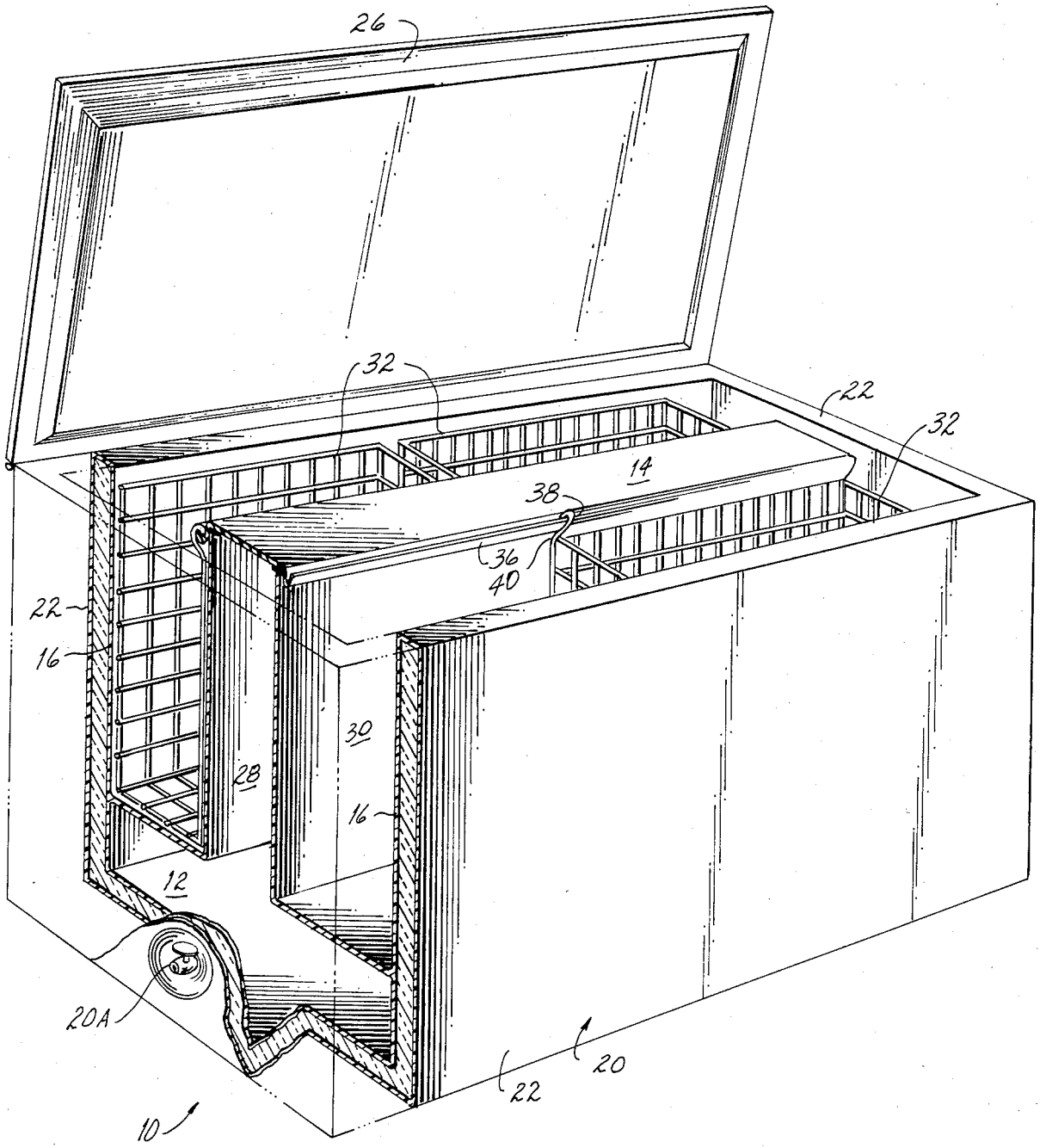
FIG. 7 is a perspective view, partially in section, of the chambered cooler of the invention manufactured intergrally with the ice chest.

The foregoing has described the chambered cooler 10 of the invention as being a device which can be inserted into premanufactured, conventional ice chests 20. However, as shown in FIG. 7, the chambered cooler 10 of the invention may be formed integrally with the ice chest 20 without departing from the spirit and scope of the invention. Specifically, with regard to the preferred embodiment of the chambered coller 10, the side walls 16 and the bottom wall 18 of the primary chamber 12 may comprise a portion of the side walls 22 with the drain 20A of the ice chest 20 connected in fluid communication with the primary chamber 12 of the chambered cooler 10. Obviously, although not shown, the second embodiment of the chambered cooler 10 may also be integrally formed with the ice chest 20 without departing from the spirit and scope of the invention.

It should be appreciated that the chambered cooler 10 of the invention may be manufactured from any type of material from metals to synthetic plastics. However, for picnic type ice chests 20, the chambered cooler is preferably manufactured from a lightweight material so that the ice chest 20 together with the chambered cooler 10 may be easily carried about by the consumer.

It should also be appreciated that while the above description has been described in relation to the cooling of articles, the chambered cooler 10 of the invention is equally suitable to heat articles positioned therein. In such instance, the chambered cooler 10 may be filled with a heat-laden material, such as hot water. In this manner, the heat from the heating medium dissipates through the walls of the chambered cooler 10 to heat the articles placed within the storage zones of the chambered cooler 10. Accordingly, for the purposes of the claims appended hereto, the word "cooler" is defined to include structure which may function to either cool or heat articles placed within the chest. Additionally, for the purpose of the claims appended hereto, the word "refrigerant" is defined to include a cooling or a heating medium.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described, what is claimed is:

1. A chambered cooler for insertion within a chest or to be integrally therewith, the chest including a chest base having upstanding side walls and a bottom wall forming an open ended chest enclosure, including a chest lid for positioning about the opened end of the chest enclosure, and being dimensioned to receive articles to be cooled or heated when placed therein, the chambered cooler comprising in combination: a watertight primary chamber, said primary chamber including a configuration approximating the interior configuration of the bottom wall of the chest base and being horizontally disposed on the bottom wall within the chest;

a watertight first secondary chamber having a top end opened along substantially the full length thereof, said first secondary chamber being vertically disposed in the chest and being connected in fluid communication with said primary chamber; and a first cooler lid fitted about said top end of said first secondary chamber for permitting filling of both said first secondary chamber and said primary chamber with the refrigerant whereby, upon placement of the articles within the chest and upon filling said chambers.

2. The chambered cooler as set forth in claim 1, wherein said secondary chamber is connected in fluid communication with said primary chamber at the middle portion thereof to define a first and a second storage zone on opposing sides of said secondary chamber above said primary chamber for placement of the articles.

3. The chambered cooler as set forth claim 2, further including a first article container for receiving the articles, said first article container being configured to fit in said first storage zone within the chest.

4. The chambered cooler as set forth in claim 3, further including first means for operatively connecting said first article container to said first cooler lid whereby the weight of said first article container retains said first cooler lid about said opened end of said secondary chamber.

5. The chambered cooler as set forth in claim 4, wherein said first connecting means comprises an upturned flange from along the edge of said first cooler lid for mating engagement with a corresponding hooked flange formed along the edge of said first article container.

6. The chambered cooler as set forth in claim 4, further including a second article container for receiving other articles, said second article container being configured to fit within said second storage zone within the chest and including second means for connecting said second article container to said first cooler lid whereby the weight of said second article container additionally retains said chambered cooler lid tightly about said opened end of said secondary chamber.

7. The chambered cooler as set forth in claim 1, further comprising a second watertight second chamber having a top end opened along substantially the full length thereof, said second secondary chamber being vertically disposed in the chest and being connected in fluid communication with said primary chamber, said secondary chamber being connected to said primary chamber at opposing edges thereof to define storage zone between said secondary chambers above said primary chamber for placement of the articles and still further comprising a second cooler lid fitted about said top end of said second secondary chamber.

8. The chambered cooler as set forth in claim 7, further including an article container for receiving the articles, said article container being configured to fit in said storage zone between said secondary chambers.

9. The chambered cooler as set forth in claim 8, further including means for operatively connected the opposing edges of said article container to the edges of the respective said cooler lids, whereby the weight of said article container retains said cooler lids about the respective opened ends of said secondary chambers.

* * * * *

UNITED STATES PATENT AND TRADEMARK OFFICE

CERTIFICATE OF CORRECTION

PATENT NO. : 4,551,988

DATED : November 12, 1985

INVENTOR(S) : Joseph Petrantoni

It is certified that error appears in the above-identified patent and that said Letters Patent is hereby corrected as shown below:

Column 4, line 54, delete the word "intergrally", insert --integrally--;

Column 4, line 56, delete the word "view", insert --views--;

Column 5, line 59, delete the word "cooled", insert --cooler--;

Column 6, line 61, delete the word "flanged", insert --flange--;

Column 7, line 14, delete the word "coller", insert --cooler--;

Column 7, line 26, following the word "cooler", insert the numeral --10--;

Column 8, line 22, following the word "forth", insert --in--;

Column 8, line 47, delete the word "second" at its second occurrence, insert --secondary--; and Column 8, at the end of line 14, delete "chambers.", insert --chambers, the articles are cooled or heated to the temperature of the refrigerant without being contaminated by the refrigerant.--.

Signed and Sealed this

*Fifth* Day of *August 1986*

[SEAL]

*Attest:*

DONALD J. QUIGG

*Attesting Officer*

*Commissioner of Patents and Trademarks*